United States Patent [19]

Howell et al.

[11] Patent Number: 4,607,148

[45] Date of Patent: Aug. 19, 1986

[54] CHANGE OF STATE CONTACT MATERIAL FOR ELECTRIC CIRCUIT INTERRUPTERS

[75] Inventors: Edward K. Howell, Simsbury; Ira B. Goldman, Naugatuck, both of Conn.

[73] Assignee: General Electric Company, New York, N.Y.

[21] Appl. No.: 763,581

[22] Filed: Aug. 8, 1985

[51] Int. Cl.[4] ..... H01H 1/02

[52] U.S. Cl. ..... 200/269

[58] Field of Search ..... 200/268, 269

[56] References Cited

U.S. PATENT DOCUMENTS

| | | | |
|---|---|---|---|
| 3,663,777 | 5/1972 | Steinmetz et al. | 200/246 |
| 3,889,098 | 6/1975 | Steinmetz et al. | 200/268 |
| 4,088,803 | 5/1978 | Kubo et al. | 200/268 |
| 4,378,479 | 3/1983 | Hieronymus | 200/263 |

FOREIGN PATENT DOCUMENTS

| | | | |
|---|---|---|---|
| 2540944 | 3/1977 | Fed. Rep. of Germany | 200/268 |

*Primary Examiner*—Stephen Marcus
*Assistant Examiner*—Renee S. Luebke
*Attorney, Agent, or Firm*—Richard A. Menelly; Walter C. Bernkopf; Fred Jacob

[57] ABSTRACT

A change of state circuit breaker contact material provides a low contact resistance at a low closing force by reducing current density through a pair of circuit breaker contacts. The use of a meltable metal alloy within the contact structure forces the current through a wider area of conduction whenever the temperature increases to melt correspondingly larger quantities of the metal alloy. The reduced contact hardness results in a substantial decrease in the force required to hold the contacts together, thereby allowing the contacts to open more quickly.

4 Claims, 4 Drawing Figures

CHANGE OF STATE CONTACT MATERIAL FOR ELECTRIC CIRCUIT INTERRUPTERS

BACKGROUND OF THE INVENTION

The advent of arcless current interruption by the use of solid state circuit components in combination with separable circuit interrupter contacts has substantially lessened the deterioration upon the contacts. This results in a smaller contact which in turn allows the contacts to open earlier in the current waveform at a lower current level. The reduction in circuit current during the interruption process synergistically allows less expensive solid state circuit components to be used within the solid state circuit interrupter. One such solid state circuit interrupter is described within U.S. patent application Ser. No. 610,947 filed May 16, 1984 entitled "Solid State Current Limiting Interrupter" in the name of E. K. Howell. This application is incorporated herein for purposes of reference.

The actual metal-to-metal interface through which current flows between a pair of electrical contacts is created by the force applied to hold the contacts together. The area ($A_c$) of this conducting interface is determined by the applied closing force (Fc) and the hardness (H) of the contact metals as defined by the expression:

$$A_c \alpha Fc/H$$

Assuming the area $A_c$ to be circular, the corresponding radius:

$$a_c=(A_c/\pi)^{\frac{1}{2}}=(Fc/H\pi)^{\frac{1}{2}}.$$

The constriction of current through the area ($A_c$) of radius ($a_c$) results in an effective constriction resistance ($R_c$). For homogenous material having a resistivity $\rho$:

$$R_c \alpha \rho/a_c=\rho(\pi H/Fc)^{\frac{1}{2}}.$$

Therefore, in order to provide a low constriction resistance ($R_c$), it is desirable to have a low resistivity material of low hardness and to apply a high closing force. Since the ratio of material hardness to closing force determines the constriction resistance, it follows that a material of reduced hardness allows use of a reduced closing force for any given resistance.

The lowest degree of hardness and the lowest force is obtained with a liquid metal, such as mercury, which has previously been used as a contact material. Mercury, which has a very high resistivity, presents additional problems when used as a contact material, such as maintaining a clean surface and confining the liquid metal. It is also difficult to deionize the mercury vapor arc which forms at high currents and voltages. Use of mercury-wetted, solid-metallic contact materials achieved low resistance by confining the high-resistivity mercury to a thin film between the lower-resistivity solid metallic contacts. This did not eliminate the surface contamination and arcing which vaporized and removed the mercury film.

An acceptable contact resistance should permit acceptable levels of current to flow without excessive voltage drop or heat generation. With commonly used contact materials such as silver, the resistance is primarily the constriction resistance, described earlier, such that most of the heat will be produced in the constriction area, raising the temperature of the contacts. Excessive temperature results in the rapid chemical reaction of the contact material with the surrounding atmosphere, and could melt the contact material and cause contact welding. It has since been observed that by increasing the current slowly through silver contacts, the temperature of the constriction area will reach approximately 180° C., which is at the softening point of silver, reducing the hardness (H) of the contacts whereupon the closing force produces an increased area of conduction, thereby reducing the constriction resistance, which then remains reduced as the current is decreased. This yielding action produced by the reduced hardness of the contacts often results in a slight sticking or low-strength welding of the contacts upon cooling. If the current is raised rapidly, such that the closing force applied to the inertial mass of the moving contact cannot move the contact fast enough to increase the conduction area, surface melting, boiling or vaporization may occur resulting in damage and welding.

The speed of contact opening is determined by application of an opening force (Fo) which exceeds the closing force (Fc) to produce an accelerating force (Fa=-Fo−Fc) acting upon the inertial mass of the moving contact. For high speed operation, it is desirable to reduce the mass and to reduce the closing force (Fc) as much as possible. The reduction in, and especially the elimination of arcing during contact separation has resulted in a significant reduction in the mass of the moving contact.

The purpose of this invention, therefore, is to reduce the closing force required for a given contact resistance to allow the contacts to be opened at a much faster rate.

SUMMARY OF THE INVENTION

Change of state contacts for electric circuit interruption are provided by an intermediate layer of a metal alloy on the surface of the base silver contact material. A surface layer of a metal having high tensile strength and a relatively high melting point protects the meltable alloy and contains the metal alloy during its liquid phase.

DESCRIPTION OF THE PREFERRED EMBODIMENT

Figure 1:
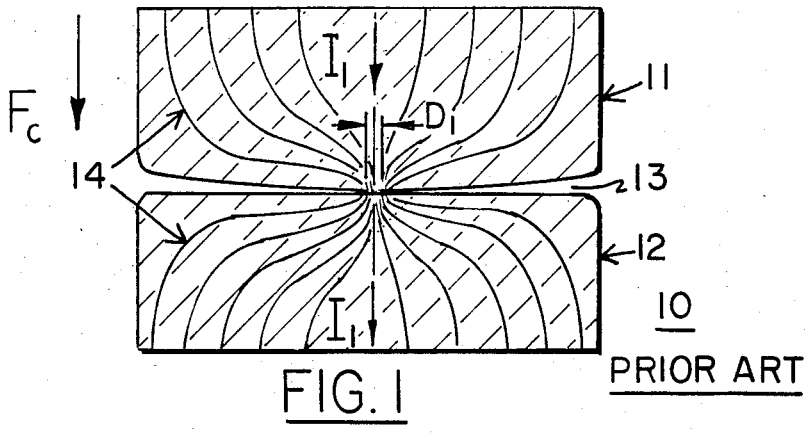
FIG. 1 is an enlarged side sectional view of a pair of circuit breaker contacts containing a silver and tungsten composition.

A contact arrangement 10 used within a molded case circuit breaker is depicted at FIG. 1 and consists of a top and bottom contact 11, 12 in a closed configuration defining an interface 13 for the passage of a current $I_1$. In order to survive the severe arcing conditions which occur during interruption of high fault currents, the contact material for the contacts 11, 12 comprises a mixture of silver and tungsten powders pressed and sintered together in a self-contained cylindrical configuration having a Brinell hardness about 180. Because of the very high hardness of the silver-tungsten contact material, a high closing force as indicated at Fc is required to obtain a small, yet adequate, constriction area of the region of contact between the contacts. The path of the circuit current $I_1$ through the contacts assumes that indicated generally at 14. Because of the high melting point of the silver-tungsten materials, the contacts remain in a solid configuration except at extrememly high overload current conditions where some localized melting of the silver is found to occur. The surface area of the interface to which the current paths 14 converge is defined by the diameter of constriction $D_1$ as indicated.

Figure 2:
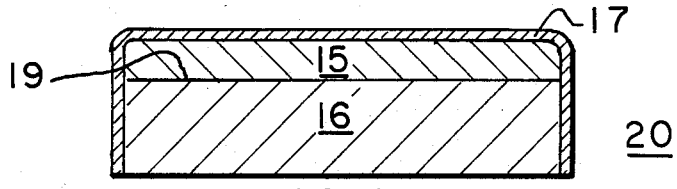
FIG. 2 is an enlarged side sectional view of a change of state contact according to the invention.

FIG. 2 shows a change of state contact 20 in accordance with the teachings of the instant invention. A silver metal base 16 is provided with an intermediate layer 15 of a metal alloy which has a hardness much lower than silver and which melts within the range of 100°–200° C. The composition of the alloy, or the selection of a single constituent metal, determines the hardness and the temperature at which melting occurs. An outer layer 17 consists of a high melting point metal having a high tensile strength, such as nickel which exhibits a melting point of approximately 1453° C. The purpose of the outer layer is to form a tough, compliant, electrically conductive membrane to protect and confine the intermediate layer which is softer, having a Brinell hardness range of from 2 to 10, and to prevent sticking or welding of the mating contact surfaces. The outer nickel layer ensures that the softer metal or alloy within the intermediate layer maintains integrity and does not spread out.

When a hybrid pair of contacts, such as a silver contact 11 and a change-of-state contact 20 shown in FIG. 2 are arranged in abutment with each other and define an interface 18, the path 21 of the circuit current $I_2$ is somewhat similar to that described earlier with reference to FIG. 1 except for having a larger diameter $D_2$ of the constriction area since the softer intermediate layer 15 provides a larger surface as indicated at 22 under the force applied by the surface of the silver contact 11 as indicated at 23. The silver base 16 and the metal alloy within the intermediate layer 15 are below their melting points and remain in solid form during acceptable levels of circuit current. If the energy dissipation in the constriction area increases the temperature appreciably, either as the result of a low closing force (Fc), higher circuit current $I_2$, or work hardening of the soft layer 15 causing inadequate contact area, the silver in both contact 11 and base 16 of contact 20 remains in solid form while a region of the intermediate metal layer 15 melts to form a liquid phase as indicated by the dashed lines in FIG. 3. Since the hardness of the liquid metal is virtually zero, the area of contact will increase, thereby decreasing the contact resistance and current density with a corresponding reduction in temperature and solidification of the molten metal within the intermediate layer. The surface layer 17 remains intact and provides a flexible diaphragm for containing the melted metal within the intermediate layer.

Figure 3:
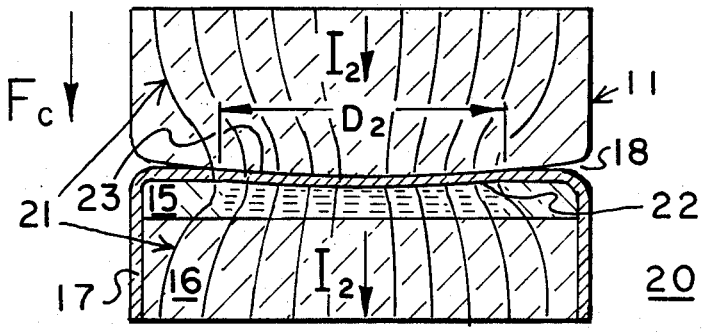
FIG. 3 is an enlarged side sectional view of a pair of contacts, one having the composition depicted in FIG. 2.
Figure 4:
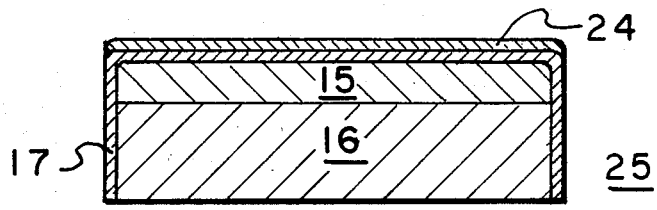
FIG. 4 is an enlarged side sectional view of a further embodiment of the change of state contact according to the invention.

To further decrease the resistance between a hybrid pair of contacts, one of which having the intermediate layer 15 depicted in FIGS. 2 and 3, a change of state contact 25 is shown in FIG. 4. The contact contains a silver base 16 and an intermediate layer 15 of low melting metals with an outer layer 17 to maintain the contact integrity when the metals within the intermediate layer become melted. A surface layer 24 of silver is applied to the outer layer 17. The presence of the surface layer protects the surface of layer 17 from chemical reactions and further reduces the temperature of the contacts. Nickel is an excellent material for providing the outer layer 17 because of its high melting point and its relatively high tensile strength. Other materials, such as copper, silver, molybdenum and tungsten, having suitable melting temperature and tensile strength can also be employed. Materials such as indium, bismuth, lead, tin having a softening temperature less than 150° C. can be employed for the intermediate layer 15. The thickness of intermediate layer 15 is preferably the minimum thickness which will conform to the contour of the mating contact surfaces under all conditions. The preferred thickness of the outer layer 17 is the minimum thickness required to prevent rupture under the hydrostatic forces present when the intermediate layer 15 melts or otherwise deforms. Since the preferred thicknesses of the outer layer and intermediate layer are both small relative to the diameter of constriction $D_2$, the current paths 21 through both of these layers define a cylinder having a low ratio of length to diameter as best shown in FIG. 3. The resistance of both these layers can therefore be very low although the resistivity of the metals comprising the layers is high compared to silver.

Since the change of state contacts 20, 25 provide a self-correcting action to decrease resistance when the contact temperature reaches the melting point of the intermediate layer 15, which is selected to be within the normal operating temperature range of the contacts, the closing force (Fc) can be made substantially lower than for silver and silver-tungsten contacts.

Having described our invention, what we claim as new and desire to secure by Letters Patent is:

1. A change of state contact interruption devices comprising:

a base layer of a first metal selected from the group consisting of copper and silver for connection with an electric circuit;

an intermediate layer of a second metal selected from the group consisting of indium, bismuth, tin and lead arranged over said base layer; and an outer layer of a third metal selected from the group consisting of copper, silver, nickel, molybdenum and tungsten arranged at least partially over said intermediate layer for confining said intermediate layer when said intermediate layer becomes distorted upon transport of said circuit current through said base, intermediate and outer layers.

2. The change of state contact for circuit interruption devices of claim 1 wherein said intermediate layer becomes at least partially melted upon reaching a predetermined temperature.

3. The change of state contact of claim 1 further including means for providing a contact closing force for reducing electrical contact resistance with said contact.

4. The change of state contact of claim 1 further including a fourth metal on said outer layer having a greater resistance to oxidation than said third metal.

* * * * *